US006520049B2

(12) United States Patent
Burgett et al.

(10) Patent No.: US 6,520,049 B2
(45) Date of Patent: Feb. 18, 2003

(54) METHOD OF DIGITIZING EMBOSS DIES AND THE LIKE

(75) Inventors: Scott M. Burgett, Overland Park, KS (US); Brent P. Ragsdale, Shawnee, KS (US); Vanessa Redshaw, Bradford (GB); David Sowden, Yorkshire (GB); John B. Watkins, Independence, MO (US)

(73) Assignee: Hallmark Cards Incorporated, Kansas City, MO (US)

( * ) Notice: Subject to any disclaimer, the term of this patent is extended or adjusted under 35 U.S.C. 154(b) by 13 days.

(21) Appl. No.: 09/844,248

(22) Filed: Apr. 27, 2001

(65) Prior Publication Data

US 2002/0174929 A1 Nov. 28, 2002

(51) Int. Cl.[7] ..... G09G 3/00
(52) U.S. Cl. ..... 76/1; 76/107.1; 345/419
(58) Field of Search ..... 76/1, 107.1; 345/419

(56) References Cited

U.S. PATENT DOCUMENTS

| | | | | |
|---|---|---|---|---|
| 3,841,762 A | | 10/1974 | Pettersson | 356/203 |
| 4,330,835 A | | 5/1982 | Gehm | 364/560 |
| 4,627,096 A | | 12/1986 | Grattoni | 382/8 |
| 4,820,932 A | | 4/1989 | Miller | 250/563 |
| 5,403,433 A | | 4/1995 | Morrison | 156/626 |
| 5,414,648 A | | 5/1995 | Morgan | 364/563 |
| 5,428,447 A | | 6/1995 | Toida | 356/372 |
| 5,585,603 A | | 12/1996 | Vogeley | 177/25.13 |
| 5,694,479 A | | 12/1997 | Guering | 382/141 |
| 5,881,444 A | * | 3/1999 | Schaefer et al. | 29/527.1 |
| 5,930,383 A | | 7/1999 | Netzer | 382/154 |
| 5,959,731 A | | 9/1999 | Jones | 356/357 |
| 6,057,924 A | | 5/2000 | Ross | 356/381 |
| 6,133,999 A | | 10/2000 | Myers | 356/239.4 |
| 6,138,052 A | * | 10/2000 | Kristensen et al. | 345/419 |
| 6,167,206 A | * | 12/2000 | Hylen | 396/316 |
| 6,338,263 B1 | * | 1/2002 | Obata et al. | 72/5 |
| 2002/0114701 A1 | * | 8/2002 | Coulson | 416/241 |

* cited by examiner

*Primary Examiner*—Douglas D. Watts
(74) *Attorney, Agent, or Firm*—Pillsbury Winthrop LLP

(57) ABSTRACT

A method of copying a three-dimensional surface having X, Y, and Z dimensions forms a translucent impression of the surface to be copied and then captures a two-dimensional image of the translucent impression. The captured image has X and Y dimensions and a grayscale value for each X, Y coordinate of the image. Then, the method converts each grayscale value of the image to a Z height value, thereby generating a digital file of X, Y, and Z values. The digital file may then be provided as an input to a numerically controlled machine, which can be operated to reproduce the surface to be copied. The method of the present invention finds particular application in digitizing handcrafted emboss dies and the like.

24 Claims, 1 Drawing Sheet

METHOD OF DIGITIZING EMBOSS DIES AND THE LIKE

FIELD OF THE INVENTION

The present invention relates generally to the field of numerically controlled manufacturing, and more particularly to a method of digitizing relief surfaces, such as emboss dies, so that such surfaces may be reproduced with numerically controlled machines.

DESCRIPTION OF THE PRIOR ART

Embossing systems are used to form an embossment or decoratively raised area on a sheet of paper or cardboard. Such an embossment may serve as a decorative feature on a greeting card, business card, or the like. Conventional embossing systems include mateable male and female dies contoured in the shape of the desired embossment. With a sheet of paper disposed between the two dies, the male and female dies are pressed together in complementary engagement with each other. The paper is thereby deformed to have an embossment matching the contour of the dies.

Traditionally, emboss dies have been handcrafted by artists. The artist carves or engraves the surface of a magnesium plate with the design to be embossed. The original magnesium die may be used to make a bake-a-lite copy of the die. Hand crafting of emboss dies requires considerable skill and talent on the part of the artist.

Recently, paper product manufacturers have begun to develop computer-aided methods of engraving emboss dies and the like. Having digitally-defined designs facilitates re-use and it makes it possible to edit and scale digital die designs. Digitally-defined designs also allow for new methods of outputting duplicate tooling based on numerically controlled milling.

Paper product manufacturers typically have a great number of existing, conventionally-created, dies. It would be desirable if manufacturers were able to digitize their existing dies in order to avail themselves of the advantages associated with digitally-defined dies. Currently, however, 3-D scanners are not adequate in terms of resolution, ease of use, or cost, to enable digitization of existing dies.

It is therefore an object of the present invention to provide a high resolution, easy to use, and low cost method of digitizing emboss dies and the like.

SUMMARY OF THE INVENTION

The present invention provides a method of copying a three-dimensional surface having X, Y, and Z dimensions. The method forms a translucent impression of the surface to be copied and then captures a two-dimensional image of the translucent impression. The captured image has X and Y dimensions and a grayscale value for each X, Y coordinate of the image. Then, the method converts each grayscale value of the image to a Z height value, thereby generating a digital file of X, Y, and Z values. The digital file may then be provided as an input to a numerically controlled machine, which can be operated to reproduce the surface to be copied. The method of the present invention finds particular application in digitizing handcrafted emboss dies and the like.

The step of forming the translucent impression may be done by pouring a resin that cures to a translucent solid onto the surface to be copied and allowing the resin to cure. Alternatively, the translucent impression may be formed by forming a layer of translucent liquid on a scanning surface and then placing the surface to be copied on the layer of translucent liquid.

The step of capturing the two-dimensional image may be done by backlighting the translucent impression or by scanning the translucent impression with a flatbed scanner in transparency mode.

The step of converting the grayscale values to Z height values is preferably performed by suitable software. One commercially available software system is artCAM Pro™, which is available from Delcam plc, of Birmingham, United Kingdom. The artCAM Pro™ software may be used to automatically create a three-dimensional relief file from an imported grayscale image.

DESCRIPTION OF THE PREFERRED EMBODIMENT

Figure 1:
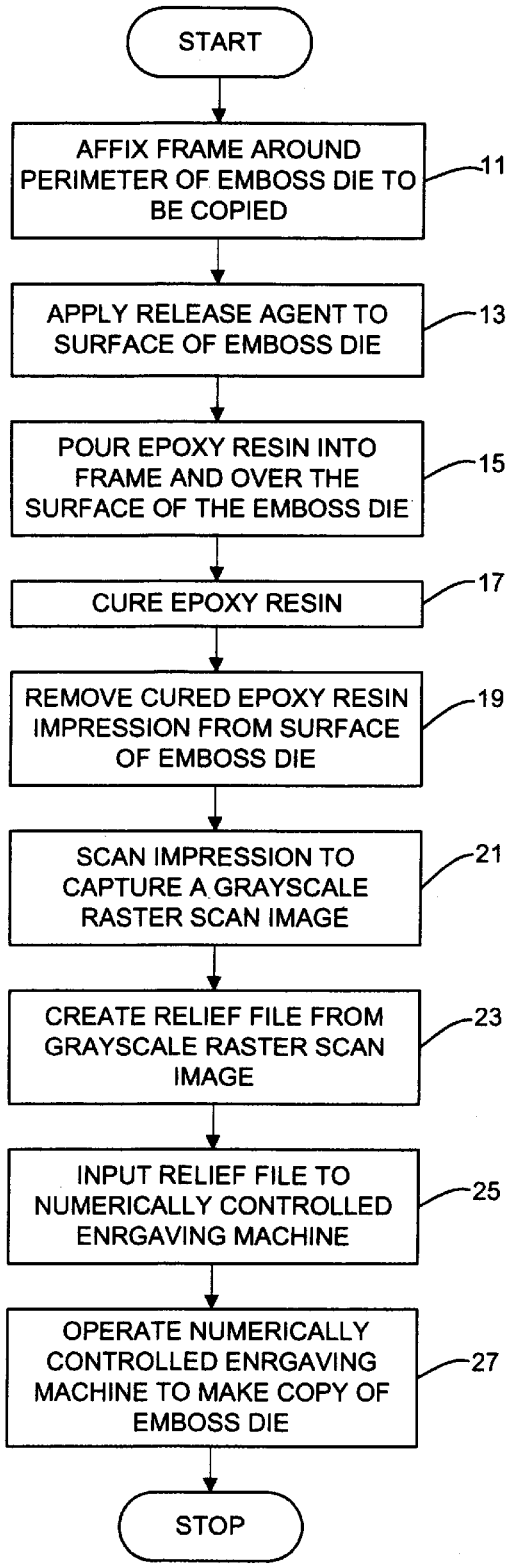
FIG. 1 is a flowchart of one embodiment of the method of the present invention.

The method of the apparatus may be described and understood with respect to the flow charts of the drawings. Referring first to FIG. 1, a frame is affixed around the perimeter of the emboss die to be copied as indicated at block 11. An emboss die comprises a sheet, preferably of magnesium or bake-a-lite, which bears a relief image. In the preferred embodiment, the frame is made of puzzle stock and it is adhered to the die surface with spray adhesive.

After affixing the frame around the perimeter of the emboss die, a release agent is applied to the surface of the emboss die, as indicated at block 13. Release agents are generally well known in the molding or casting art. After applying the release agent, a liquid epoxy resin is poured into the frame and over the surface of the emboss die, as indicated at block 15. The epoxy resin is pre-mixed and it is selected so as to form a translucent solid when cured.

After pouring the epoxy resin into the frame and over the surface of the emboss die, the epoxy resin is cured, as indicated at block 17. In the preferred embodiment, prior to curing, a sheet of film is placed over the top surface of the liquid epoxy resin and then a piece of magnesium, or other material is placed over the plastic film. The liquid epoxy is thus sandwiched between the dye and the top sheet of magnesium or the like. The curing step is preferably performed in a heated press.

After the epoxy resin has cured, the cured epoxy resin impression is removed from the surface of the emboss die, as indicated at block 19. The method of the present invention is based upon the Bouguer-Lambert law of optics, which states that the intensity of light passing through a homogeneous translucent material will be inversely proportional to the thickness of the material. By backlighting a translucent material of varying thickness, a continuous tone monochromatic or grayscale image can be created. An object that exhibits this effect is commonly called a lithophane.

According to the present invention, the epoxy resin impression is scanned to capture a grayscale raster scan image, as indicated at block 21. In the preferred embodiment, the scanning step is performed with a conventional flatbed scanner operating in transparency mode. The scanning step transforms the 3-dimensional (x, y, z) image into a 2-dimensional (x, y) image where the gray value of each pixel correlates to the height of the die at each x, y location.

The resulting grayscale image is often referred to as a depth map and it can be readily imported into various 3-D computer-aided design or modeling software programs. One such program is the ArtCAM Pro™, which is commercially available from Delcam PLC, of Birmingham, United Kingdom. The ArtCAM product has a feature called ArtEmboss, which creates a relief file from a grayscale image, as indicated at block 23. Prior to importing the 2-dimensional grayscale image into the 3-dimensional software, the grayscale image can be processed using a program like Adobe™ Photoshop™ so that the white and black points, as well as the linearization of the mapping, can be adjusted. The overall height (z) as well as the scale (x, y) of the relief that is created in the 3-D software is defined when the relief is generated. This is typically done by defining white as having a height of zero and black as having a specified height, or vice versa.

After the relief file has been generated, the file may be saved for further use or processing. For example, the file may be edited or scaled. The file may be used to create a copy of the original emboss die. In that case, the relief file is input into a numerically controlled engraving machine, as indicated at block 25, after which the numerically controlled engraving machine may be operated to make a copy of the original emboss die, as indicated at block 27.

Figure 2:
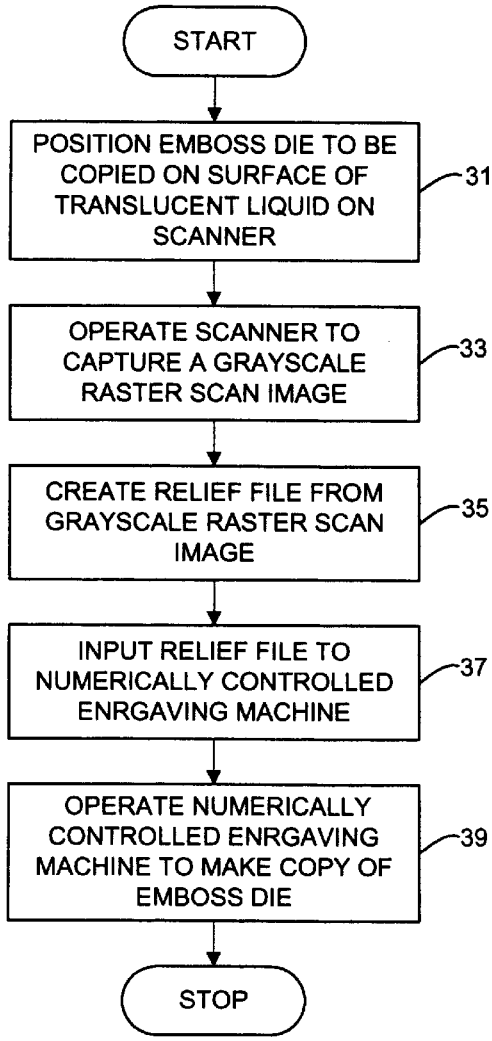
FIG. 2 is a flowchart of a second embodiment of the method of the present invention.

Referring now to FIG. 2, there is illustrated a flow chart of an alternative embodiment of the method of the present invention. In the embodiment of FIG. 2, a high-resolution scanner is outfitted with a waterproof frame caulked to the glass of the scanner bed. The frame is filled with a translucent medium, which may be a liquid, gel, gas, or the like. An example of a translucent medium is skim milk. Then, the emboss die to be copied is positioned on the surface of the translucent liquid on the scanner, as indicated at block 31. Then, the scanner is operated to capture a grayscale raster image of the emboss die to be copied, as indicated at block 33. After the scanning step of block 33, the method if FIG. 2 proceeds in the same manner as the method of FIG. 1. A relief file is created from the grayscale raster scan image, at block 35, in the manner described with respect to block 23. The relief file may then be input to a numerically controlled engraving machine, at block 37, and the machine may be operated to make a copy of the emboss die, as indicated at block 39.

From the foregoing, it may be seen that the method of the present invention provides a high resolution, easy to use, and low cost method of digitizing emboss dies and the like. Grayscale values captured according to the present invention map accurately to height values and conventional scanners have high resolutions in terms of both grayscale and dots per inch. Accordingly, existing emboss dies can be reproduced using modern digital machining technologies.

What is claimed is:

1. A method of digitizing an emboss die, which comprises the steps of:

forming a translucent three-dimensional impression of a surface of an emboss die;

scanning said impression to capture a two-dimensional gray scale image; and, converting gray scale values of said image to height values.

2. The method as claimed in claim 1, wherein said step of forming said translucent impression includes the step of:

pouring a translucent liquid onto the surface of said emboss die.

3. The method as claimed in claim 2, wherein said translucent liquid is a settable resin.

4. The method as claimed in claim 3, wherein said step of forming said translucent impression includes the step of:

allowing said settable resin to set to a translucent solid state.

5. The method as claimed in claim 3, wherein said step of forming said translucent impression includes the step of:

curing said resin to a translucent solid state.

6. The, method as claimed in claim 1, wherein said step of forming said translucent impression includes the steps of:

forming a layer of translucent liquid on a scanning surface; and, placing said emboss die on said layer of translucent liquid.

7. The method as claimed in claim 6, wherein said step of scanning said impression includes the steps of:

scanning said scanning surface with said emboss die on said layer of translucent liquid.

8. The method as claimed in claim 1, wherein said step of forming said translucent impression includes the steps of:

affixing a frame to the surface of said emboss die;

pouring a settable resin into said frame and over the surface of the emboss die;

allowing said settable resin to set into a translucent solid state; and, removing the translucent solid from the surface of the emboss die.

9. The method as claimed in claim 8, including the step of:

prior to pouring said settable resin, coating the surface of the emboss die with a release agent.

10. The method as claimed in claim 8, wherein said step of scanning said impression includes the step of:

scanning said impression on a flatbed scanner in transparency mode.

11. A method of copying a three-dimensional surface having X, Y, and Z dimensions, which comprises the steps of:

forming a translucent impression of said surface;

capturing a two-dimensional image of said translucent impression, said image having X and Y dimensions and a grayscale value for each X, Y coordinate of said image; and, converting each grayscale value of said image to a Z height value to generate a digital file of X, Y, and Z values.

12. The method as claimed in claim 11, wherein said three-dimensional surface is the surface of an emboss die.

13. The method as claimed in claim 11, including the step of inputting said digital file to a numerically controlled machine.

14. The method as claimed in claim 13, including the step of:

operating said numerically controlled machine to reproduce said three dimensional surface.

15. The method as claimed in claim 11, wherein said step of capturing said two-dimensional image includes the step of:

backlighting said translucent impression.

16. The method as claimed in claim 11, wherein said step of capturing said two-dimensional image includes the step of:

scanning said translucent impression with a flatbed scanner in transparency mode.

17. The method as claimed in claim 11, wherein said step of forming said translucent impression includes the step of:

pouring a translucent liquid onto said surface.

18. The method as claimed in claim 17, wherein said translucent liquid is a settable resin.

19. The method as claimed in claim 18, wherein said step of forming said translucent impression includes the step of:

allowing said settable resin to set to a translucent solid state.

20. The method as claimed in claim 18, wherein said step of forming said translucent impression includes the step of:

curing said resin to a translucent solid state.

21. The method as claimed in claim 11, wherein said step of forming said translucent impression includes the steps of:

forming a layer of translucent liquid on a scanning surface; and, placing the surface to be copied on said layer of translucent liquid.

22. The method as claimed in claim 21, wherein said step of scanning said impression includes the steps of:

scanning said scanning surface with said surface to be copied on said layer of translucent liquid.

23. The method as claimed in claim 11, wherein said step of forming said translucent impression includes the steps of:

affixing a frame to the surface to be copied;

pouring a settable resin into said frame and over the surface to be copied;

allowing said settable resin to set into a translucent solid state; and, removing the translucent solid from the surface to be copied.

24. The method as claimed in claim 23, including the step of:

prior to pouring said settable resin, coating the surface to be copied with a release agent.

* * * * *